US005387383A

United States Patent [19]

Collier et al.

[11] Patent Number: 5,387,383

[45] Date of Patent: Feb. 7, 1995

[54] PROCESS OF MAKING SHEATH/CORE COMPOSITE PRODUCTS

[75] Inventors: John R. Collier; Billie J. Collier, both of Baton Rouge, La.

[73] Assignee: Board of Supervisors of Louisiana State University and Agricultural and Mechanical College, Baton Rouge, La.

[21] Appl. No.: 166,071

[22] Filed: Dec. 13, 1993

Related U.S. Application Data

[62] Division of Ser. No. 857,374, Mar. 25, 1992, Pat. No. 5,272,005.

[51] Int. Cl.[6] ..... B05D 3/10; B05D 7/02; D01F 8/02

[52] U.S. Cl. ..... 264/129; 264/171; 264/211.14; 264/211.15; 427/301; 427/339; 427/400

[58] Field of Search ..... 264/129, 171, 211.14, 264/211.15; 427/301, 339, 400

[56] References Cited

U.S. PATENT DOCUMENTS

| | | | |
|---|---|---|---|
| 4,871,791 | 10/1989 | Hammer et al. | 524/35 |
| 3,824,146 | 7/1974 | Ellis | 428/296 |
| 4,336,297 | 6/1982 | Fushiki et al. | 428/284 |
| 4,483,976 | 11/1984 | Yamamoto et al. | 528/295 |
| 4,559,862 | 12/1985 | Case et al. | 87/1 |
| 4,596,742 | 6/1986 | Selivansky et al. | 428/373 |
| 4,680,156 | 7/1987 | Collier | 264/171 |
| 4,927,698 | 5/1990 | Jaco et al. | 428/198 |
| 4,950,541 | 8/1990 | Tabor et al. | 428/373 |
| 5,009,954 | 4/1991 | Collier et al. | 428/400 |

OTHER PUBLICATIONS

Southern et al., "Improved Sheath/Core Adhesion in Biconstituent Fibers via Interface Mixing," Textile Res. J., vol. 50, pp. 411–416 (1980).

Collier et al., "Adhesion Promotion in Rayon/Nylon Skin/Core Bigeneric Fibers," Clothing & Textile Res. J., vol. 11, pp. 18–25 (1993).

Tao, "Interfacial Adhesion in Rayon/Nylon Sheath-/Core Composite Fibers," PhD Dissertation, Louisiana State University (1991).

*Primary Examiner*—Leo B. Tentoni

*Attorney, Agent, or Firm*—John H. Runnels

[57] ABSTRACT

Rayon/nylon and other sheath/core composite fibers or other materials, with good adhesion between sheath and core resulting from an adhesion promoter. The adhesion promoter is difunctional and sterically hindered. Fumaric acid and terephthalic acid are preferred adhesion promoters for the composite fibers or other materials, because each compound has both difunctionality and steric hinderance, allowing either to form covalent bonds to both the sheath and the core. Fibers produced in accordance with this invention may be used to produce fabrics which have the strength and wrinkle resistance shown by a number of synthetic fibers, but with the water absorption characteristics of natural fibers such as cotton.

16 Claims, No Drawings

PROCESS OF MAKING SHEATH/CORE COMPOSITE PRODUCTS

The development of this invention was partially funded by the Government under grants MSM8896Q33 and INT8896Q31 awarded by the National Science Foundation. The Government may have certain rights in this invention.

This is a divisional of copending application Ser. No. 07/857,374, filed Mar. 25, 1992, now U.S. Pat. No. 5,272,005, issued Dec. 21, 1993, the entire disclosure of which is incorporated by reference.

This invention pertains to improved sheath/core composite materials, such as composite fibers, particularly to sheath/core composite fibers or other materials in which a difunctional, sterically hindered adhesion promoter binds the core to the sheath. Sheath/core composite structures other than fibers which may be made according to this invention include films, ribbons, and shaped extrudates.

U.S. Pat. No. 4,950,541 discloses bicomponent fibers with a polyester or polyamide core, and a sheath of grafted polyethylene. The grafting of the polyethylene may be performed in a twin screw extruder by reaction with maleic acid or maleic anhydride, or with fumaric acid. Fumaric acid is said to be usable because it is first converted to maleic anhydride by heat. Grafting to the polyethylene occurs via reaction with the double bond in the maleic acid. Adhesion of the bicomponent fibers to a matrix or to other fibers is mentioned, but not adhesion of the sheath to the core within the bicomponent fibers.

U.S. Pat. No. 3,824,146 discloses sheath/core bicomponent fibers, such as a polyester core/cellulose ester sheath, in which the sheath serves to adhere the fiber to some other surface. The disclosure mentions, in general terms only, the possibility of using a third component to provide adequate adhesion between the core and the sheath.

U.S. Pat. No. 4,927,698 discloses bicomponent filaments including a first crosslinkable resin having an affinity for the core filament, and a second crosslinkable resin having an affinity both for the sheath fibers and the first crosslinkable resin.

Other references showing the general state of the art include U.S. Pat. Nos. 4,336,297; 4,680,156; 4,871,791; 4,483,976; 4,559,862; and 4,596,742; and Southern et. al., "Improved Sheath/Core Adhesion in Biconstituent Fibers via Interface Mixing," Textile Res. J., Vol. 50, pp 411–16 (1980).

It is desirable to produce fabrics which have the strength and wrinkle resistance shown by a number of synthetic fibers, but with the water absorption characteristics of natural fibers such as cotton. One approach to this goal is to produce a bicomponent fiber in which the core and sheath have different properties. For example, the core may be an oriented or partially oriented fiber such as nylon 6, nylon 66, other nylons, polyesters, or polypropylene. The sheath may be a cellulosic material such as a rayon skin.

A problem in prior bicomponent fibers is that the skin typically has not adhered well to the core, particularly if the latter has smooth surfaces. Existing commercial coupling agents, such as silanes, have not given good results to the inventors' knowledge. It has been observed that silanes tend to bond to the core only, and not to the skin.

An improved sheath/core composite fiber or other material with a synthetic core and a rayon or other skin has been invented. In one embodiment, a fiber is produced by a coating process in which a core fiber passes through a fiber coating die, where it contacts viscose rayon. The rayon coating is then regenerated in a sulfuric acid bath. The core fiber dominates the mechanical properties of the composite fiber, and the rayon skin dominates the surface properties.

An important aspect of this invention is the high degree of adhesion which may be obtained between the core and the skin. An effective coupling agent or adhesion promoter, as well as preferred application conditions for optimal interfacial adhesion, have been discovered.

An adhesion promoter in accordance with the present invention is a molecule which is both difunctional and sterically hindered. As used here, a "difunctional" molecule is a molecule which has a first functional group capable of adhering or binding to a first component or core, and which has a second functional group capable of adhering or binding to a second component or sheath or skin. The two functional groups may be, but are not necessarily, the same. As used here, a "sterically hindered" difunctional molecule is a difunctional molecule with sufficient steric hindrance between the two functional groups that the two functional groups on a single molecule are unlikely both to bind to the first component, and are also unlikely both to bind to the second component. In particular, the fraction of difunctional molecules with both functional groups bound to the same component is not so high as to significantly reduce the overall degree of adhesion between the two components.

Based on these criteria, as well as on relative cost, fumaric acid or terephthalic acid is preferred specifically for pretreating nylon core fibers to enhance adhesion between the nylon fiber and a rayon skin. Possible core fibers include polyamides or nylons such as nylon 66, nylon 6, nylon 610, nylon 612, etc., and copolymers containing these groups; as well as polyesters such as polyethylene terephthalate, polybutylene terephthalate, etc., and copolymers containing these groups. (As used herein, the term "nylon" is considered to be synonymous with "polyamide.")

The structures of fumaric acid and terephthalic acid are:

Fumaric Acid

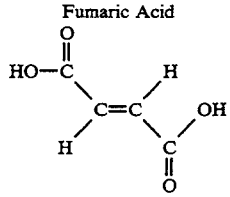

Terephthalic Acid

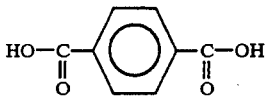

Both of these acids have two end carboxylic acid functional groups. Fumaric acid is the trans configuration of a difunctional acid, trans-1,2-ethylene dicarboxylic acid. (The cis configuration is maleic acid). The double bond between the second and the third carbon atoms of fumaric acid restricts rotation from the trans to the cis configuration. Because rotation about the double bond is hindered, reaction of both carboxyl groups with a single surface is inhibited. Although fumaric acid itself is preferred where that dicarboxylic acid is to be used, precursors which yield fumaric acid under reaction conditions may also be used, such as maleic acid or maleic anhydride.

Terephthalic acid is the para form of phthalic acid, i.e., carboxylic acid groups are on the 1 and 4 position carbon atoms of a six-carbon phenyl group. The two carboxyl groups are therefore sterically hindered from both bonding to the same surface.

The steric hinderance of these two dicarboxylic acids is demonstrated, for example, by the inability to form an anhydride monomer of either fumaric acid or terephthalic acid. By contrast, monomeric anhydrides form readily from either maleic acid or ortho-phthalic acid.

Other difunctional or trifunctional, sterically hindered compounds which may also be useful as adhesion promoters in the present invention include the following: meta-phthalic acid; 1,3,5-benzenetricarboxylic acid; 1,2,4-benzenetricarboxylic acid or its anhydride; and 2,4,6-triamino-1,3,5-triazine.

The core fiber used in one embodiment of this invention was an 80 denier nylon 66. Ethanol was used to dissolve the fumaric acid, because fumaric acid's solubility in water is low (less than 0.5%). An azeotropic mixture of ethanol and water (95.57% ethanol) may be preferable as a solvent over pure ethanol, because such an azeotropic mixture would presumably lower the thermodynamic tendency of two fumaric acid molecules to react with one another to form an anhydride dimer, liberating a water molecule, and decreasing the overall degree of the desired steric hindrance. Furthermore, the azeotrope would likely tend to form anyway after several distillations of ethanol when used in this process.

Table 1 gives the experimental conditions used for several treatments. An incomplete randomized factorial experiment was used to determine the effects of concentration, pretreatment time, and the interaction of concentration and time on adhesion in rayon/nylon composite fibers. One half percent, 9 seconds; and 2%, 36 seconds as pretreatment conditions were excluded from these treatments based on results from preliminary trial runs (not shown), because neither low concentration (0.5%) at the shortest pretreatment time (9 seconds), nor high concentration (2.0%) at the longest pretreatment time (36 seconds), were expected to promote adhesion well. After removal of the spin finish by one hour of water washing, the nylon 66 fibers were pretreated with fumaric acid at the selected pretreatment concentrations and times, and then were passed through a coating die where they were coated by a commercial grade of viscose rayon flowing from a reservoir at 10 kPa feed gauge pressure. The coated fiber then passed through a commercial strength rayon coagulation bath, containing 9 weight percent sulfuric acid and 13 weight percent sodium sulfate. In this bath cellulose was regenerated from the viscose, forming a solid white rayon coating, and trapping the fumaric acid between the skin and the core. The coated fiber was dried and wound on a take-up device, and was then washed with water after holding for 15 minutes. Such a delayed water wash is preferred, because it was found to lead to better adhesion and to the formation of a smoother surface. Preliminary trial runs had indicated that both a longer residence time of the coated fiber in the sulfuric acid bath, and a high drying temperature range (80°–90° C.) improved adhesion by increasing the degree of covalent bonding between both surfaces and the fumaric acid. The total regeneration time includes the residence time in the sulfuric acid bath and any delay prior to washing. Washing the coated fiber with water in line immediately after the acid bath decreases the effective regeneration time. A post water wash therefore permits an effectively longer regeneration time for the viscose to react with the sulfuric or other mineral acid.

A preferred method for making fibers in accordance with this invention (not yet tested as of the filing date of this application) may be to coat multiple fibers in a bundle, from which fabrics may then be formed. The coating will be performed with a venturi-type die (with a converging, then diverging channel) fed by rollers. This method should permit controlled use of the rheological and surface tension properties of the viscose rayon solution and surface free energy of the core fibers to enhance the coating effect.

TABLE 1

| | Experimental Conditions | | | |
|---|---|---|---|---|
| Fiber | Fumaric acid concentration (%) | Pretreatment time (second) | Coating speed (m/min) | Drying temperature |
| 1 | 0.5 | 18 | 21 | high |
| 2 | 0.5 | 27 | 21 | high |
| 3 | 0.5 | 36 | 21 | high |
| 4 | 1.0 | 9 | 21 | high |
| 5 | 1.0 | 18 | 21 | high |
| 6 | 1.0 | 27 | 21 | high |
| 7 | 1.0 | 36 | 21 | high |
| 8 | 1.5 | 9 | 21 | high |
| 9 | 1.5 | 18 | 21 | high |
| 10 | 1.5 | 27 | 21 | high |
| 11 | 1.5 | 36 | 21 | high |
| 12 | 2.0 | 9 | 21 | high |
| 13 | 2.0 | 18 | 21 | high |
| 14 | 2.0 | 27 | 21 | high |

A Fourier transform infrared spectrophotometer (FTIR) was used to identify the chemical bonds formed between the nylon core fiber and the fumaric acid, as well as those between the rayon coating and the fumaric acid. Potassium bromide powder was mixed with chopped or ground samples, and then pressed to form pellets. Each pellet was observed with the FTIR to obtain infrared spectra.

Hydrogen bonds can form between cellulose and polyamide molecules, and between fumaric acid and either cellulose or polyamide. With a mineral acid catalyst (such as the sulfuric acid from the regeneration bath) and elevated temperature, a carboxyl group from fumaric acid can react with an amine end group from nylon, forming a stable amide linkage similar to those formed during the polymerization of nylon itself. It is therefore thought to be desirable to have a small amount of acid residue remaining to catalyze this curing step. Due to steric hindrance, the other carboxyl end of the fumaric acid molecule will react primarily with the hydroxyl groups of rayon to form stable ester bonds.

To confirm the formation of amide bonds between fumaric acid and nylon, and the formation of ester bonds between fumaric acid and rayon (as opposed to hydrogen bonds), a series of fibers was prepared and examined with the FTIR. Fumaric acid was coated on the fibers where indicated, and the treated fibers were then subjected either to the process described above, or to conditions simulating the process where appropriate. Simulation of the process was used where a rayon coating was not deposited on top of the fumaric acid layer, because the rayon physically inhibits the removal of fumaric acid during subsequent treatment of the composite fibers. By contrast, an unprotected, hydrogen-bonded fumaric acid layer on either nylon or rayon would be susceptible to removal by the mechanical action of pulling the fiber through the sulfuric acid coagulation bath. Where simulation was used for a sample, the fumaric acid-coated fiber was heated to 80° to 90° C. for at least 15 minutes in the presence of sulfuric acid in a non-flow system.

The formation of amide bonds between fumaric acid and nylon was difficult to detect directly because the nylon structure already contains amide groups. However, indirect confirmation of their formation was obtained. Rayon-coated nylon fibers with a fumaric acid treatment exhibited two peaks or shoulders at 3111 and 3314 $cm^{-1}$ on the side of a stronger 3432 $cm^{-1}$ band. The stronger band at 3432 $cm^{-1}$ is due to the trans amidic N—H stretching in nylon, unhindered by hydrogen bonding. The shoulders are due to the effect of hydrogen bonding between cellulose and some of the amidic N—H groups in nylon. When the nylon core fibers with fumaric acid are coated with rayon and then undergo the processing treatment, the 3111 and 3314 $cm^{-1}$ peaks do not appear. This change in the spectrum indicates that a relatively small number of amidic groups are involved in hydrogen bonding. Another indication of the primary bonding of fumaric acid to nylon involves the trans =CH wagging peak of fumaric acid. In pure fumaric acid, this peak occurs at 971 $cm^{-1}$. After treating nylon fibers with fumaric acid, this peak shifted to 983 $cm^{-1}$. This shift was due to the change of the carboxyl group bonded to the =CH to an amide bond.

The same trans =CH wagging peak at 971 $cm^{-1}$ is also affected by ester bond formation between fumaric acid and rayon. When rayon fibers were treated with fumaric acid, this peak was shifted to 973 $cm^{-1}$. An ester bond is not as energetically disruptive of the trans =CH wagging as is an amide bond, because the bond is formed one atom farther away for an ester. Further indication of the formation of ester bonds was given by the 1720 $cm^{-1}$ stretching of an ester bond. This peak was observed in rayon fibers treated with fumaric acid, but is absent in untreated rayon fibers. In addition, the 3084 $cm^{-1}$ =C—H stretching bond in pure fumaric acid was shifted to 3086 $cm^{-1}$ in rayon fibers treated with fumaric acid, again indicating an energetic change in the region near this =C—H group. All the above IR observations are consistent with, and indicative of, the formation of ester bonds between fumaric acid and rayon, and amide bonds between fumaric acid and nylon. Hydrogen bonding alone would not be consistent with these IR observations, nor with the adhesion results described below.

After the fiber was coated, a fiber pull adhesion test measured the interfacial adhesion of the composite fibers. In this technique, two Taber Calibrase CS-10 wheels (which are used in a different configuration to test abrasion resistance of fabrics in ASTM Standard D3884-80) were adapted and mounted in contact with one another on their rims. A weighed length of coated fiber was pulled through the nonrotating wheels at a speed of 5.2 m/min. The distance between the wheel centers, which determines the compressive force, was adjustable. The wheels were compressed at different compressive forces, the fibers were pulled through the wheels, and the fibers were tested for coating failure. The coating weight loss and the interfacial shear strength were determined.

Tests indicated that a position of 0.25 mm past the impingement point of the wheels was the best position to distinguish differences in coating loss for different composite fibers without fiber breakage.

The percent coating weight loss, WL, is given by:

$$WL=(W1-W2)/(W1-W3)*100\%$$

where

W1 is the weight of the coated fiber before testing

W2 is the weight of the coated fiber after testing, and

W3 is the weight of the uncoated fiber.

The higher the weight loss, the poorer the adhesion between sheath and core.

The applied interfacial shear stress $\tau$ was determined using the following formula:

$$\tau = \frac{P\mu}{\pi d_f l} \quad (1)$$

where the applied compressive force P was determined by:

$$P = \frac{YbE}{x[1.788x^2 + 3.091 - 0.637/(1 + 12x^2)]} \quad (2)$$

where $Y$ = wheel deflection caused by the compressive load
= distance past the impingement point/2
$b$ = wheel length = 13 mm
$x$ = ratio of mean radius to wheel thickness
= $((R + r)/2)/(R - r) = 1.4$
$E$ = wheel modulus of elasticity = 11 MPa From equation (2), $P$ = $0.0155*10^6*Y$ (in Newtons)
$\mu$ = frictional coefficient between the wheel and the composite fiber = 0.6
$d_f$ = fiber diameter = 0.102 mm
$l$ = embedment length
= $2(R^2 - (R - Y)^2)^{\frac{1}{2}}$ From equation (1), $$\tau = 1873\ P/l \text{ (in Pascals)} \quad (3)$$

A high interfacial stress value indicates good adhesion.

The formation of covalent bonds improved the adhesion between the skin and the core. Table 2 shows Duncan post hoc analysis of variance results of the fiber pull adhesion test by coating weight loss. Table 2 shows that both pretreatment concentration and time affected adhesion. However, the interaction (i.e. the pretreatment concentration multiplied by the pretreatment time) was more significant than either of the two factors alone. The following three combinations gave no appreciable coating weight loss, and are preferred: (1) a 1.0% fumaric acid concentration with a 36 second pretreatment time, (2) a 1.5% fumaric acid concentration with an 18 second pretreatment time, and (3) a 2.0% fumaric acid concentration with a 9 second pretreatment time. Other combinations resulted in poorer bonding, with weight losses of up to about thirty percent.

TABLE 2

Duncan's Multiple Range Test for Concentration/Time Interaction Effect

| Concentration (%) | Time (sec) | Mean weight loss (%) | Standard deviation (%) | Duncan grouping* |
|---|---|---|---|---|
| 1.0 | 9 | 28.707 | 2.908 | A |
| 0.5 | 18 | 25.344 | 1.914 | B |
| 0.5 | 27 | 21.626 | 2.668 | C |
| 0.5 | 36 | 20.400 | 1.829 | C |
| 1.5 | 36 | 13.194 | 1.912 | D |
| 1.0 | 18 | 12.491 | 2.120 | D |
| 1.5 | 9 | 9.344 | 1.040 | E |
| 1.0 | 27 | 8.275 | 1.773 | E F |
| 1.5 | 27 | 8.040 | 2.107 | E F |
| 2.0 | 27 | 7.716 | 1.993 | E F |
| 2.0 | 18 | 7.337 | 1.411 | F |
| 1.5 | 18 | 0.812 | 1.309 | G |
| 1.0 | 36 | 0.715 | 1.509 | G |
| 2.0 | 9 | 0.536 | 1.133 | G |

*Entries with the same letters in this column are not statistically different.

Table 3 shows the calculated values of the applied interfacial shear stress using Equation (3). It is seen from Table 3 that the interfacial shear strength of the bond of the poor adhesion fibers was at least 0.37 MPa, that of the fair adhesion fibers was at least 0.75 MPa, and that of the best adhesion fibers was at least 1.12 MPa. These measurements are consistent with the weight loss measurements.

TABLE 3

Interfacial Shear Strength of The Composite Fiber

| Pretreatment | Distance Past Impingement(mm) | | Compressive Force (N) | | Interfacial Shear Strength (MPa) | |
|---|---|---|---|---|---|---|
| Condition | Survive | Fail | Survive | Fail | Survive | Fail |
| All 0.5% fumaric acid treatments & 1.0% fumaric acid 9 sec. 1.0% fumaric acid 18 & 27 sec 1.5% fumaric acid 9,27,36 sec 2.0% fumaric acid 18 & 27 sec | 0.05 | 0.10 | 0.39 | 0.78 | 0.37 | 0.53 |
| | 0.20 | 0.25 | 1.55 | 1.94 | 0.75 | 0.83 |
| 1.0% fumaric acid 36 sec 1.5% fumaric acid 18 sec 2.0% fumaric acid 9 sec | 0.45 | Fiber breakage 0.50 mm | 3.49 | Fiber breakage prior to debonding | 1.12 | Fiber breakage prior to debonding |

In addition to the applications to textiles previously mentioned, bicomponent fibers in accordance with the present invention should also find applications in other fields. Highly oriented fibers will generally have high strength, but their surfaces tend to crack easily. However, a low orientation skin inhibits cracking. Thus bicomponent fibers in accordance with the present invention having graphite or other highly oriented cores may exhibit high strength, with a high resistance to cracking from a low orientation skin. This invention is not limited to sheath/core fibers, but may also be used in other sheath/core structures, such as those with a skin layer on a core of polyamide or polyester sheets, ribbons, films or extruded shapes. These new composites could be more printable, dyeable, comfortable if used near the skin, etc.

The entire disclosures of the following three references are incorporated by reference; it is noted that none of these references are prior art to this invention: U.S. Pat. No. 5,009,954; Collier et al., "Adhesion Promotion in Rayon/Nylon Skin/Core Bigeneric Fibers (1993); Tao, "Interfacial Adhesion in Rayon/Nylon Sheath/Core Composite Fibers," PhD Dissertation, Louisiana State University (1991).

We claim:

1. A process for making a composite fiber, comprising the steps of:

(a) treating a core fiber with an adhesion promoter which will bind to the core fiber, wherein the adhesion promoter is difunctional and is sterically hindered; and (b) reacting the adhesion promoter with a cellulosic material which will bind to the adhesion promoter;

whereby a composite fiber is formed in which the adhesion promoter binds a cellulosic skin to the core fiber.

2. A process as recited in claim 1, wherein said adhesion promoter is selected from the group consisting of fumaric acid; terephthalic acid; meta-phthalic acid; 1,3,5-benzenetricarboxylic acid; 1,2,4-benzenetricarboxylic acid; 2,4,6-triamino-1,3,5-triazine; meta-phhthalic anhydride; 1,3,5-benzenetricarboxylic anhydride; and 1,2,4 -benzenetricarboxylic anhydride.

3. A process as recited in claim 1, wherein:

(a) the core fiber comprises a polyester or a nylon;

(b) the adhesion promoter comprises fumaric acid;

(c) the cellulosic material comprises viscose rayon; and (d) said reacting step comprises coating the treated core fiber with the viscose rayon, reacting the coated core fiber with a strong acid, whereby the cellulosic skin is formed; and heating the reacted core fiber to 80°–90° C., whereby adhesion between the core fiber and the cellulosic skin is enhanced.

4. A process as recited in claim 3, wherein the core fiber comprises a nylon.

5. A process as recited in claim 3, wherein the core fiber comprises a polyester.

6. A process as recited in claim 1, wherein:
(a) the core fiber comprises a polyester or a nylon;
(b) the adhesion promoter comprises terephthalic acid;
(c) the cellulosic material comprises viscose rayon; and
(d) said reacting step comprises coating the treated core fiber with the viscose rayon, reacting the coated core fiber with a strong acid, whereby the cellulosic skin is formed; and heating the reacted core fiber to 80°-90° C., whereby adhesion between the core fiber and the cellulosic skin is enhanced.

7. A process as recited in claim 6, wherein the core fiber comprises a nylon.

8. A process as recited in claim 6, wherein the core fiber comprises a polyester.

9. A process for making a composite material, comprising the steps of:
(a) treating a core with an adhesion promoter which will bind to the core, wherein the adhesion promoter is difunctional and is sterically hindered; and
(b) reacting the adhesion promoter with a cellulosic material which will bind to the adhesion promoter;
whereby a composite material is formed in which the adhesion promoter binds a cellulosic skin to the core.

10. A process as recited in claim 9, wherein said adhesion promoter is selected from the group consisting of fumaric acid; terephthalic acid; meta-phthalic acid; 1,3,5-benzenetricarboxylic acid; 1,2,4-benzenetricarboxylic acid; 2,4,6-triamino-1,3,5-triazine; meta-phthalic anhydride; 1,3,5-benzenetricarboxylic anhydride; and 1,2,4-benzenetricarboxylic anhydride.

11. A process as recited in claim 9, wherein:
(a) the core comprises a polyester or a nylon;
(b) the adhesion promoter comprises fumaric acid;
(c) the cellulosic material comprises viscose rayon; and
(d) said reacting step comprises coating the treated core with the viscose rayon, reacting the coated core with a strong acid, whereby the cellulosic skin is formed; and heating the reacted core to 80°-90° C., whereby adhesion between the core and the cellulosic skin is enhanced.

12. A process as recited in claim 11, wherein the core comprises a nylon.

13. A process as recited in claim 11, wherein the core comprises a polyester.

14. A process as recited in claim 9, wherein:
(a) the core comprises a polyester or a nylon;
(b) the adhesion promoter comprises terephthalic acid;
(c) the cellulosic material comprises viscose rayon; and
(d) said reacting step comprises coating the treated core with the viscose rayon, reacting the coated core with a strong acid, whereby the cellulosic skin is formed; and heating the reacted core to 80°-90° C., whereby adhesion between the core and the cellulosic skin is enhanced.

15. A process as recited in claim 14, wherein the core comprises a nylon.

16. A process as recited in claim 14, wherein the core comprises a polyester.

* * * * *